US005209630A

United States Patent [19]

Roth

[11] Patent Number: 5,209,630

[45] Date of Patent: May 11, 1993

[54] PUMP IMPELLER

[75] Inventor: Robert A. Roth, Grand Blanc, Mich.

[73] Assignee: General Motors Corporation, Detroit, Mich.

[21] Appl. No.: 907,999

[22] Filed: Jul. 2, 1992

[51] Int. Cl.[5] ..... F01D 3/00

[52] U.S. Cl. ..... 415/55.1

[58] Field of Search ..... 415/55.1, 55.2, 55.3, 415/55.4; 416/223 R

[56] References Cited

U.S. PATENT DOCUMENTS

| | | | |
|---|---|---|---|
| 1,768,243 | 6/1930 | Ferguson | 415/55.1 |
| 3,418,991 | 12/1968 | Shultz et al. | 123/179 |
| 3,658,444 | 4/1972 | Rhodes et al. | 417/423 |
| 3,676,025 | 7/1972 | Shultz et al. | 417/423 |
| 3,947,149 | 3/1976 | MacManus | 415/213 |
| 4,209,284 | 6/1980 | Lochmann et al. | 417/366 |
| 4,734,008 | 3/1988 | Roth | 415/53 |
| 4,834,612 | 5/1989 | Lahn et al. | 415/119 |

FOREIGN PATENT DOCUMENTS

| | | | |
|---|---|---|---|
| 487484 | 12/1929 | Fed. Rep. of Germany | 415/55.1 |

*Primary Examiner*—John T. Kwon

*Attorney, Agent, or Firm*—Saul Schwartz

[57] ABSTRACT

An open-vane impeller for a regenerative turbine fuel pump for motor vehicles, the impeller including a hub having an outer cylindrical ring, a first stage of open-vane impeller vanes extending radially out from the outer ring, and a second stage of open-vane impeller vanes extending radially out from the outer ring in side-by-side and phase shifted relationship to the first stage of open-vane impeller vanes.

7 Claims, 2 Drawing Sheets

PUMP IMPELLER

FIELD OF THE INVENTION

This invention relates open-vane regenerative turbine pumps particularly suited for motor vehicle fuel pump applications.

BACKGROUND OF THE INVENTION

U.S. Pat. No. 3,418,991, issued Dec. 31, 1968 and assigned to the assignee of this invention, describes an electric fuel pump in a motor vehicle fuel tank having a regenerative turbine pump including an open-vane impeller rotatable at high speed in a housing of the pump. As used herein, open-vane regenerative turbine pump vanes are vanes projecting radially from an impeller hub defining wedge-shaped vane pockets between adjacent pairs of vanes which pockets are substantially completely open on both sides of the respective pockets. In the aforesaid U.S. Pat. No. 3,418,991, the vanes on the open-vane impeller are irregularly spaced around the circumference of the hub for noise suppression.

U.S. Pat. Nos. 4,209,284 and 4,734,008, issued Jun. 24, 1980 and Mar. 29, 1988, respectively, and assigned to the assignee of this invention, describe electric fuel pumps in motor vehicle fuel tanks each having a two-stage regenerative turbine pump including a pair of open-vane impellers with irregularly spaced vanes. In the aforesaid U.S. Pat. No. 4,734,008, one of the open-vane impellers also has a hub including a plurality of radial spokes which define fan blades for improving the vapor handling characteristics of the pump.

An open-vane regenerative turbine pump impeller according to this invention is a novel alternative o the impellers described in the aforesaid U.S. patents.

SUMMARY OF THE INVENTION

This invention is a new and improved open-vane impeller for a regenerative turbine motor vehicle fuel pump. The impeller according to this invention includes a hub adapted for driving attachment to an electric motor armature shaft and a pair of open-vane vane stages on the hub in side-by-side, phase shifted relationship to each other. The side-by-side, phase shifted relationship of the vane stages effectively increases the number of vanes on the open-vane impeller for maximum suppression of audible noise. In a preferred embodiment of the open-vane impeller according to this invention, the hub includes an outer ring integral with the vanes of each vane stage, an inner ring adapted for attachment to the aforesaid armature shaft, and a plurality of integral radial spokes between the inner and outer rings defining fan blades for maximizing the vapor handling characteristics of the impeller.

DESCRIPTION OF A PREFERRED EMBODIMENT

Figure 1:
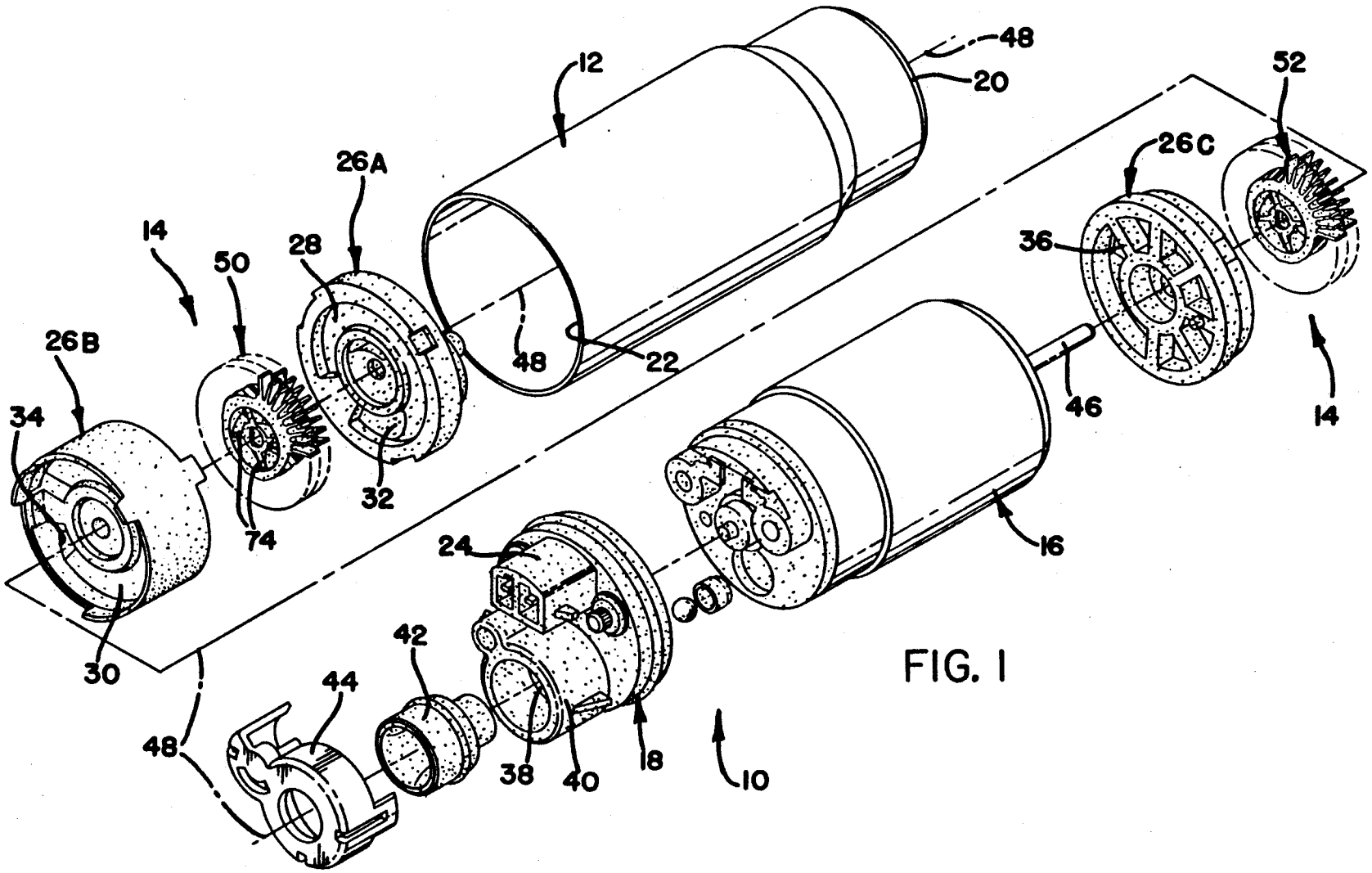
FIG. 1 is an exploded perspective view of an electric fuel pump including a regenerative turbine pump having an open-vane impeller according to this invention.

Referring to FIG. 1, an vehicle electric fuel pump (10) for a motor vehicle includes a tubular metal shell (12) open at both ends, a two stage pump (14), a discrete electric motor (16), and an end cap (18). The pump (14) closes a first end (20) of the shell and is retained in the latter by a lip, not shown, at the first end. The end cap (18) closes a second end (22) of the shell and is retained by crimping the edge of the shell at the second end around the end cap. The motor (16) is turned on and off through a connector (24) on the end cap to which a wiring harness, not shown, is attached. The fuel pump (10) is typically located in the fuel tank of the motor vehicle.

The pump (14) includes a plurality of molded plastic housing elements (26A–C) keyed together in non-rotative relationship and defining therebetween an annular first stage pump chamber (28) and an annular second stage pump chamber (30). The first stage chamber (28) has an inlet port (32) in the housing element (26A) through which fuel enters the chamber from the fuel tank, not shown, of the motor vehicle. The second stage pump chamber has an inlet port (34), partially visible in FIG. 1, in the housing element (26B) through which fuel exiting the first stage chamber (28) enters the second stage chamber. The second stage chamber (30) has a discharge port (36), partially visible in FIG. 1, in the housing element (26C) through which the output of the pump (14) exits the second chamber (30).

The housing element (26C) butts against the discrete motor (16) and is anchored to the latter to prevent rotation of the housing elements relative to the motor. Fuel exiting the discharge port (36) is conducted internally through the discrete motor (16) to a passage (38) in a boss (40) on the end cap (18). A seal (42) seats in the boss (40) and is held in by a retainer (44). The seal (42) receives an end of a fuel pipe, not shown, through which fuel is conducted from the fuel pump (10) to the engine of the motor vehicle.

The motor (16) has an armature shaft (46) on a longitudinal centerline (48) of the shell (12) which projects into each of the first and second chambers (28,30) of the pump (14). An open-vane regenerative turbine impeller (50) according to this invention is disposed in the first chamber (28) and operates as a vapor separating, low pressure first stage of the pump (14). A second impeller (52) is disposed in the second chamber (30) and operates as a high pressure second stage of the pump (14). Depending upon the performance characteristics of the fuel pump (10) such as, for example, discharge pressure, any suitable impeller may be used in the second chamber (30).

Referring to FIGS. 1-5, the impeller (50) according to this invention is preferably molded in one piece from Poly Phenelyne Sulfide with 32.5% glass and 32.5% mineral and includes a hub (54) and a pair of side-by-side first and second open-vane vane stages (56,58), respectively. The hub includes an inner ring (60) and a concentric outer ring (62) each bounded at opposite longitudinal ends by respective ones of a pair of substantially coplanar first end walls (64,66) and by respective ones of a pair of substantially coplanar second end walls (68,70). The planes of the first and second end walls are perpendicular to an axis of rotation of the impeller through a geometric center (72) thereof. The hub further includes a plurality of flat spokes (74) between and integral with the inner and outer rings. The spokes (74) extend radially relative to the geometric center (72) of the impeller and are curved to define a corresponding plurality of fan blades for improving the vapor handling characteristics of the pump (14) as described in the aforesaid U.S. Pat. No. 4,734,008.

The first vane stage (56) includes a plurality of flat open-vane vanes (76) molded integrally with the outer ring (62) of the hub and extending radially relative to the geometric center (72) of the impeller. Each vane (76) has a first or outboard edge (78) in the plane of the first end walls (64,66) of the inner and outer rings (60,62) and a second or inboard edge (80), FIGS. 3 and 5, in a parallel plane generally in the center of the impeller. Similarly, the second vane stage (58) includes a plurality of flat open-vane vanes (82) molded integrally with the outer ring (62) of the hub and extending radially relative to the geometric center (72) of the impeller. The vanes (82) are identical in shape to the vanes (76) in the first vane stage (56). Each vane (82) has a first or outboard edge (84) in the plane of the second end walls (68,70) of the inner and outer rings (60,62) and a second or inboard edge (86) in the aforesaid parallel plane containing the inboard edges (80) of the vanes (76).

Figure 2:
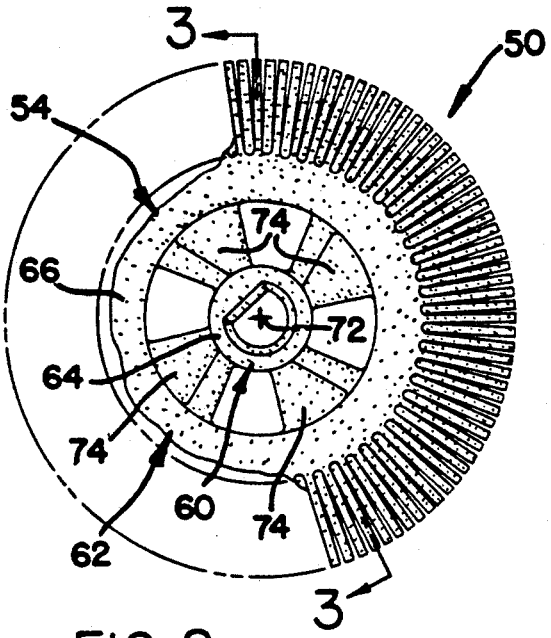
FIG. 2 is an enlarged view of the open-vane impeller according to this invention.
Figure 3:
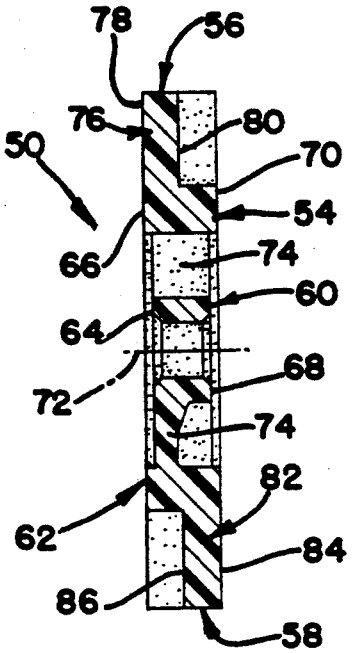
FIG. 3 is a sectional view taken generally along the plane indicated by lines 3—3 in FIG. 2.
Figure 4:
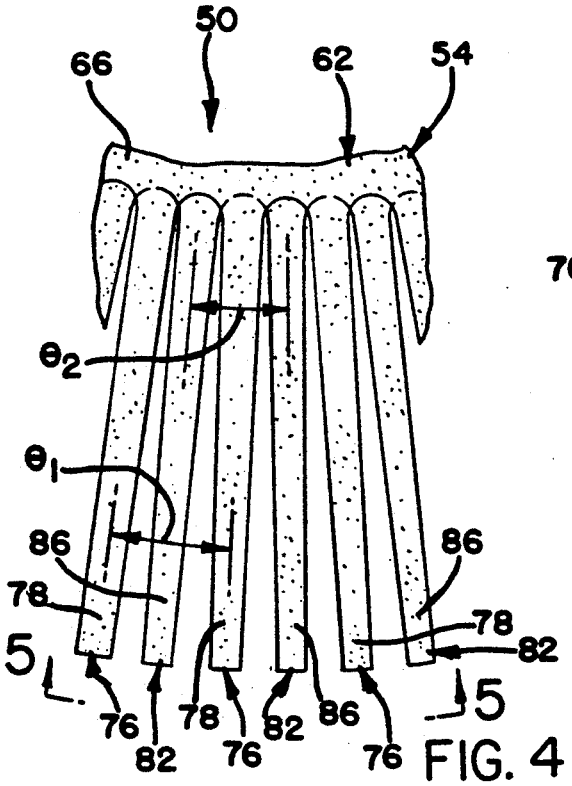
FIG. 4 is an enlarge view of a portion of FIG. 2.
Figure 5:
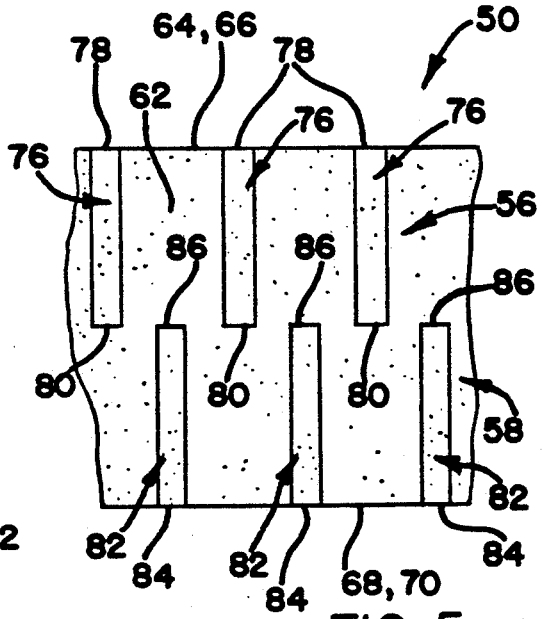
FIG. 5 is a view taken generally along the plane indicated by lines 5—5 in FIG. 4.

As best seen in FIGS. 2 and 4–5, the vanes (76) in the first vane stage (56) of the impeller (50) are uniformly spaced around the circumference of the outer ring (62) of the hub (54) and intercept an angular interval $\theta_1$ between adjacent pairs of vanes. The angular interval $\theta_1$ is preferably the minimum interval achievable with high volume, commercial plastic molding equipment to maximize the number of vanes (76) in the first vane stage. In a practical realization of the impeller (50), (60) first stage vanes, 5.4 mm in radial length and separated by an angular interval $\theta_1$ equal to 6 degrees, were successfully molded on an outer ring (62) having an outside diameter of 17.8 mm.

Likewise, the vanes (82) in the second vane stage (58) of the impeller (50) are uniformly spaced around the circumference of the outer ring (62) of the hub (54) and intercept an angular interval $\theta_2$ between adjacent pairs of vanes. The angular interval $\theta_2$ is preferably the minimum interval achievable with high volume, commercial plastic molding equipment to maximize the number of vanes (82) in the second vane stage and, in the preferred embodiment, is the same as the angular interval $\theta_1$ between the vanes (76) in the first vane stage. In the aforesaid practical realization of the impeller (50), (60) second stage vanes, 5.4 mm in radial length and separated by an angular interval $\theta_2$ equal to 6 degrees, were successfully molded on the 17.8 mm outside diameter outer ring (62).

As seen best in FIGS. 4–5, the first and second vane stages (56,58) are phase shifted relative to each other by about one-half the angular interval between adjacent pairs of vanes (76) and vanes (82). Accordingly, each vane (76) in the first vane stage bisects the angular interval $\theta_2$ between a longitudinally adjacent pair of vanes (82) in the second vane stage (58). It is believed that phase shifting the vane stages on the impeller (50) as described effectively increases the number of vanes on the impeller for noise suppression purposes so that the impeller (50) is quieter than an impeller of the same size but with conventional, full width open-vane vanes thereon. In the aforesaid practical realization of the impeller (50), the first and second vane stages were phased shifted by about 3 degrees.

The vanes (76,82) in the first and second vane stages are referred to as open-vane vanes because the wedge-shaped pockets between each adjacent pair of vanes are open in the aforesaid parallel planes containing the end walls (64,66) and (68,70) and in the aforesaid plane between the planes of the end walls. It is contemplated that the open-vane vanes (76,82) may be interconnected near their respective radial outer ends by a ring-shaped web, not shown, for reinforcing the vanes against beam bending about their roots at the outer ring (62). Such a reinforcing web blocks only a small fraction of the sides of the wedge-shaped pockets between the vanes and does not interfere with the usual open-vane regenerative pumping operation of the impeller (50).

The embodiments of the invention in which an exclusive property or privilege is claimed are defined as follows:

1. An open-vane impeller for a regenerative turbine pump comprising:
   - a hub having a cylindrical outer ring centered on a rotational axis of said impeller,
   - means defining a first stage of open-vane impeller vanes on said cylindrical outer ring extending radially out therefrom, and
   - means defining a second stage of open-vane impeller vanes on said cylindrical outer ring extending radially out therefrom in side-by-side and phase shifted relationship to said first stage of open-vane impeller vanes on said cylindrical outer ring.

2. An open-vane impeller for a regenerative turbine pump comprising:
   - a hub having a cylindrical outer ring centered on a rotational axis of said impeller and bounded on a first side by an a first end wall in a first plane perpendicular to said rotational axis and on a second side by a second end wall in a second plane perpendicular to said rotational axis,
   - means defining a first stage of open-vane impeller vanes on said cylindrical outer ring extending radially out therefrom with a longitudinally outboard edge of each of said open-vane impeller vanes in said first stage disposed in said first plane and a longitudinally inboard edge disposed in a third plane perpendicular to said rotational axis between said first and said second planes, and
   - means defining a second stage of open-vane impeller vanes on said cylindrical outer ring extending radially out therefrom in side-by-side and phase shifted relationship to said first stage of open-vane impeller vanes,
   - each of said open-vane impeller vanes in said second stage having a longitudinally outboard edge disposed in said second plane and a longitudinally inboard edge disposed in said third plane.

3. The impeller recited in claim 2 wherein:
   - each of said first and said second stage of open-vane impeller vanes on said outer ring of said hub includes an identical number of open-vane impeller vanes.

4. The impeller recited in claim 3 wherein:
   - each of said open-vane impeller vanes in said first stage and each of said open-vane impeller vanes in said second stage is integral with said cylindrical outer wall of said hub.

5. The impeller recited in claim 4 wherein:
   - said open-vane impeller vanes in said first stage are uniformly spaced around the circumference of said outer ring of said hub, and said open-vane impeller vanes in said second stage are uniformly spaced around the circumference of said outer ring.

6. The impeller recited in claim 5 wherein:

said first stage of open-vane impeller vanes is phase shifted relative to said second stage of open-vane impeller vanes by about one-half of the angular interval intercepted between adjacent pairs of open-vane impeller vanes in said first stage.

7. The impeller recited in claim 4 wherein said hub further includes:

a cylindrical inner ring concentric with said cylindrical outer ring and adapted for driving engagement with a drive shaft, and a plurality of spokes integral with each of said cylindrical inner and said cylindrical outer rings defining a plurality of fan blades in an annulus between said cylindrical inner and said cylindrical outer rings.

* * * * *